US005209160A

United States Patent [19]

Smith

[11] Patent Number: 5,209,160

[45] Date of Patent: * May 11, 1993

[54] BLOWER MOUNTING FOR DAMPENING FLUID EVAPORATOR

[76] Inventor: Maurice D. Smith, 4440 Northcrest, Dallas, Tex. 75229

[ * ] Notice: The portion of the term of this patent subsequent to Feb. 4, 2009 has been disclaimed.

[21] Appl. No.: 830,945

[22] Filed: Feb. 4, 1992

Related U.S. Application Data

[63] Continuation-in-part of Ser. No. 622,323, Nov. 28, 1990, Pat. No. 5,085,142, which is a continuation of Ser. No. 165,519, Mar. 8, 1988, abandoned.

[51] Int. Cl.[5] ..... B41F 7/26; B41F 7/36

[52] U.S. Cl. ..... 101/148; 101/349; 101/450.1

[58] Field of Search ..... 101/147, 148, 144, 141, 101/349-352, 207-210, 450.1, 487; 34/114, 122

[56] References Cited

U.S. PATENT DOCUMENTS

| | | | |
|---|---|---|---|
| 1,022,379 | 4/1912 | Pope | 34/114 X |
| 1,212,643 | 1/1917 | Hopewell | 34/114 X |
| 2,196,412 | 4/1940 | Greenbecki | 101/148 X |
| 2,733,653 | 2/1956 | Mullen | 101/147 |
| 2,843,040 | 7/1958 | Childers | 101/141 |
| 4,452,139 | 6/1984 | Dahlgren et al. | 101/148 |
| 4,470,347 | 9/1984 | Johne et al. | 101/148 |
| 4,524,689 | 6/1985 | Gemaster | 101/141 |
| 4,527,471 | 7/1985 | Dahlgren et al. | 101/148 |
| 4,753,165 | 6/1988 | Grosshauser | 101/148 |
| 5,085,742 | 2/1992 | Smith | 101/148 |

FOREIGN PATENT DOCUMENTS

| | | | |
|---|---|---|---|
| 925116 | 3/1955 | Fed. Rep. of Germany | 101/147 |
| 929612 | 6/1955 | Fed. Rep. of Germany | 101/147 |
| 2658875 | 6/1978 | Fed. Rep. of Germany | 101/147 |
| 461042 | 1/1951 | Italy | 101/147 |
| 256858 | 9/1948 | Sweden | 101/147 |

OTHER PUBLICATIONS

Dayton Transflow Blower Model 4C874-Operating Instructions and Parts Manual-Form 582814-Dayton Electric Manufacturing Co.

*Primary Examiner*—J. Reed Fisher
*Attorney, Agent, or Firm*—Crutsinger & Booth

[57] ABSTRACT

A dampening fluid evaporator for a lithographic printing press which incorporates an elongated transflow blower which is mounted to be driven by a roller in the inking system. The blower is formed by a plurality of impeller segments mounted end to end.

12 Claims, 6 Drawing Sheets

BLOWER MOUNTING FOR DAMPENING FLUID EVAPORATOR

CROSS-REFERENCE TO RELATED APPLICATIONS

This application is a continuation-in-part of my copending application Ser. No. 07/622,323, filed Nov. 28, 1990, now. U.S. Pat. No. 5,085,142, which was a continuation of U.S. application Ser. No. 07/165,519 filed Mar. 8, 1988, abandoned, entitled "DAMPENING FLUID EVAPORATOR", the disclosure of which is incorporated herein by reference in its entirety for all purposes.

TECHNICAL FIELD

The blower mounting for dampening fluid evaporator relates to improvements in a device for evaporating dampening fluid which infiltrates the ink train in a lithographic printing press.

BACKGROUND OF THE INVENTION

This invention relates generally to lithographic printing presses and more particular concerns a method and apparatus for evaporating excess dampening fluid which infiltrates the ink train during the lithographic printing process.

The inevitable infiltration by dampening fluid into the ink train system of lithographic printing presses is well known in the art. With the virtual elimination of alcohol as a drying agent, the problem of infiltration has been aggravated by the use of alcohol substitutes which, unlike alcohol, do not indicate that infiltration has occurred until extensive damage is already sustained. The presence of dampening fluid in the ink train adversely affects both image quality and color consistency, and when left uncorrected can result in ruined paper and contamination of the ink fountain.

Previous attempts to eliminate dampening fluid from the ink train of lithographic printing presses have proved costly, complex, and generally involve elaborate plumbing networks which pipe air from external air compressors to air jet manifolds or nozzles which direct streams of air to impinge against inker rollers in the printing press in an effort to evaporate excess dampening fluid. These complex assemblies are inherently noisy and, in addition, have a limited capacity to supply a large volume of air. Typical systems are disclosed in U.S. Pat. No. 4,624,689 entitled "DEHYDRATION APPARATUS FOR PRINTING PRESS INKING SYSTEM" issued Jun. 25, 1985 to Milton R. Lemaster, and U.S. Pat. No. 4,452,139 entitled "DAMPENING FLUID EVAPORATOR AND METHOD" issued Jun. 5, 1984 to Dahlgren et al.

The use of air compressor units for delivering pressurized air to jet manifolds or nozzles within the printing press is expensive in terms of power consumption, floor space, and plumbing costs. Further, air bars and manifolds sometimes limit access to the rollers in the press.

With the discovery of the present invention substantial improvements have been made in the elimination of dampening fluid in lithographic printing presses: reductions in cost; ease of installation; virtual elimination of noise; and delivery of a high volume of air at a variable speed.

SUMMARY OF THE INVENTION

It is an object of this invention to provide a method and apparatus for easily and inexpensively evaporating excess dampening fluid from the ink of a printing press. The apparatus disclosed herein comprises an elongated fan mounted in the printing press and positioned to blow air on rollers in an ink train for evaporating dampening fluid. Further, it is an additional object of the present invention to provide an evaporative system which operates in conjunction with the ink train and automatically discontinues operation when the ink train rollers are momentarily stopped.

In accordance with the invention there is provided method of evaporating dampening fluid from the surface of a roller in an ink train, incorporating an elongated fan positioned adjacent a roller and coupled to the roller in such a fashion as to permit the rotation of the roller to impart force to drive the fan such that the operation of the fan is controlled by the rotation of the roller. As an alternative, there is a method provided to evaporate dampening fluid by an independent means of rotation with a variable speed.

Other objects and advantages of the invention will become apparent upon reading the following description of a preferred embodiment and upon reference to the drawings.

BRIEF DESCRIPTION OF THE DRAWINGS

Drawings of two embodiments of the invention are annexed hereto so that the invention may be better and more fully understood, in which.

Numeral references are employed to designate like parts throughout the various figures of the drawing.

DESCRIPTION OF A PREFERRED EMBODIMENT

Figure 1:
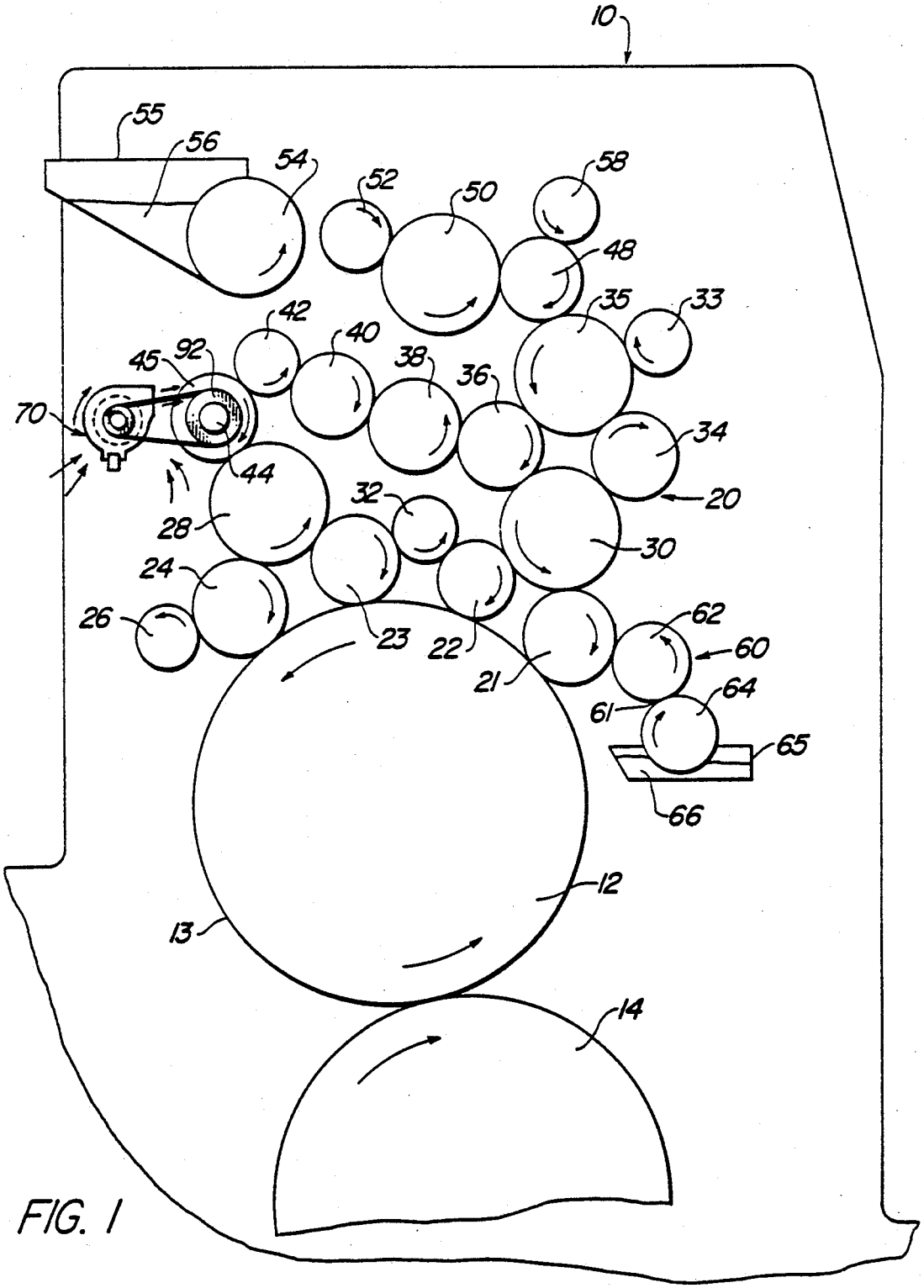
FIG. 1 is a schematic illustration of a lithographic printing press showing an end view of the blower assembly.

A first embodiment of the dampening fluid evaporator, generally designated by the numeral 70, is illustrated in FIG. 1 of the drawing to evaporate excess dampening fluid from rollers in an inking system generally designated by the numeral 20 in a printing press 10.

The printing press generally designated by the numeral 10 is of conventional design and comprises a lithographic plate cylinder 12 having a printing plate 13 mounted on the surface thereof in rolling engagement with a blanket cylinder 14 rotatably supported by press side frames 15 and 16.

Inker 20 is of conventional design and comprises resilient surfaced form rollers 21, 22, 23 and 24 which apply ink and dampening fluid to the surface of lithographic printing plate 13. An equalizer roller 26 is in rolling engagement with the last ink form roller 24. Vibrator rollers 28, 30 and 32 oscillate longitudinally relative to form rollers 21, 22, 23 and 24 for distributing ink onto the surface of the rollers and to eliminate "ghosting".

Ink is delivered to vibrator rollers 28 and 30 over ink supply rollers 34 and 36. Ink supply roller 36 delivers ink to the surfaces of ink distributor rollers 38, 40, 42 and 45 as will be hereinafter more fully explained. An equalizing roller 33 is in rolling engagement with ink supply roller 35 which engages ink supply rollers 34 and 36 and receives ink from ink supply rollers 48 and 50. A ductor roller 52 oscillates between fountain roller 54 and ink supply roller 50. Fountain roller 54 is submerged in a supply of ink 56 in ink reservoir 55. Equalizer rollers 33 and 58 function as ink storage rollers engaging supply rollers 35 and 48 to equalize films and split films of ink carried by the surfaces of the rollers of the train of rollers in inker 20 enroute to the surface of printing plate 13.

Inker 20 is of conventional design and may assume other and further configurations. The dampening system generally designated by the numeral 60 is preferably of the type disclosed in U.S. Pat. No. 3,343,484 for forming a thin film of dampening fluid and applying the film to the first inker form roller 21. Inker 60 generally comprises a hydrophilic transfer roller 62 in pressure indented relation with a resilient covered metering roller 64 which receives dampening fluid 66 from a dampening fluid reservoir 65. As metering roller 64 rotates dampening fluid is carried on its surface to the nip 61 between metering roller 64 and transfer roller 62. The surface speed of transfer roller 62 controls the rate at which a film of dampening fluid is offered to the surface of first inker form roller 21. The dampening system generally designated by the numeral 60 is of conventional design and may assume other and further configurations.

From the foregoing it should be readily apparent that ink from the ink reservoir 65 is delivered over a train of rollers in inker 20 and combined with a film of dampening fluid supplied by dampener 60 for application to the lithographic printing plate 13. As noted hereinbefore, the inker 20 and dampening system 60 are of conventional design and form no part of the present invention except in combination with the dampening fluid evaporator 70.

As is well known to persons skilled in the art, the film of dampening fluid formed by the dampening system 60 is applied to the surface of ink on the first form roller and dampens the hydrophilic non-image areas on the surface of printing plate 13 while ink is transferred to image areas on printing plate 13. Some of the dampening fluid applied to printing plate 13 is transferred to the subsequent form rollers 22, 23 and 24 while a portion of the film of dampening fluid which remains on the first form roller 21 is transferred over roller 30 to other rollers in the inking system 20.

Dampening fluid evaporator 70 is preferably mounted to evaporate excess dampening fluid from the surface of ink distribution roller 45 to prevent accumulation of excessive quantities of dampening fluid on the surfaces of train of rollers in inker 20.

Figure 3:
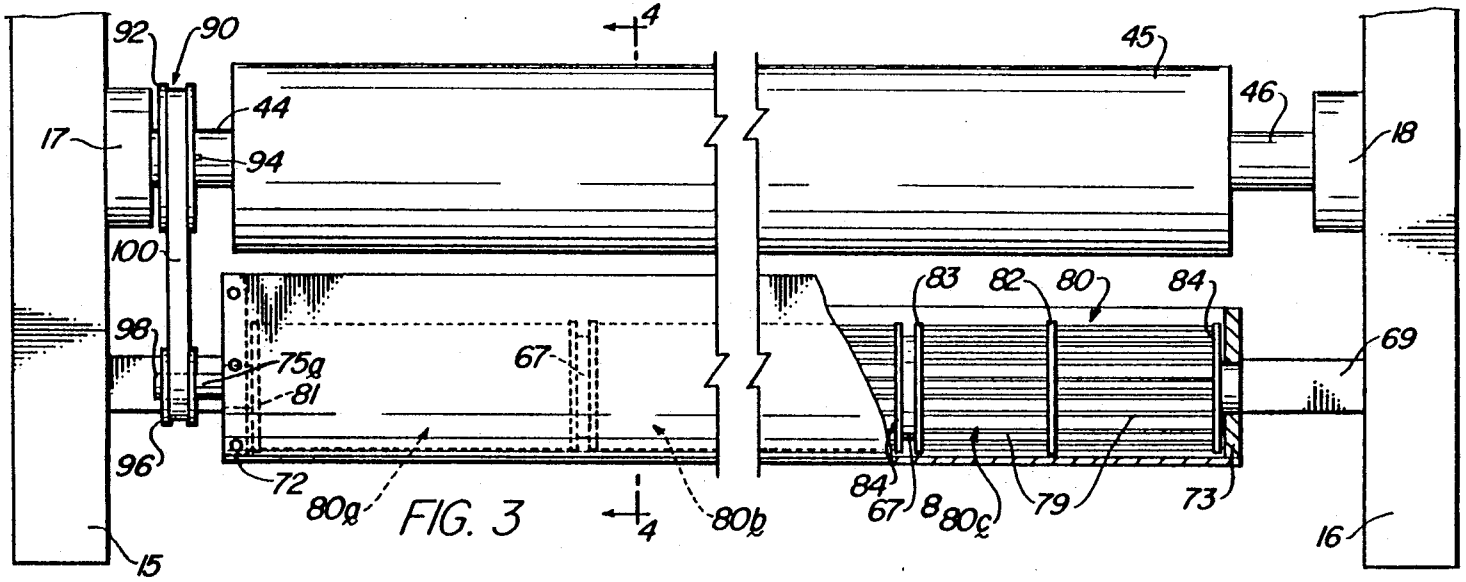
FIG. 3 is a top view of the blower assembly.

As best illustrated in FIGS. 1 and 3 of the drawing, ink distribution roller 45 has journals 44 and 46 formed on opposite ends thereof which are rotatably supported in bearings 17 and 18 on press side frames 15 and 16.

Suitable drive means 90 is provided to transfer driving force from ink distributor roller 45 to the dampening fluid evaporator 70. In the embodiment illustrated in FIGS. 1–5, the drive means comprises a pulley 92 secured by a key 94 to journal 44 of ink distribution roller 45. In the embodiments illustrated in FIG. 7 and in FIGS. 8 and 9, the evaporator is driven by an electric motor.

In the embodiment of the invention illustrated in the drawings, impeller 80 comprises a plurality of impeller segments 80*a*, 80*b*, and 80*c* connected end to end and adapted to rotate together as a unit.

As illustrated in FIG. 3 of the drawing, each impeller segment is provided with an end plate 83 adjacent one end thereof and end plate 84 adjacent the opposite end thereof, impeller blades 79 extending therebetween.

Figure 5:
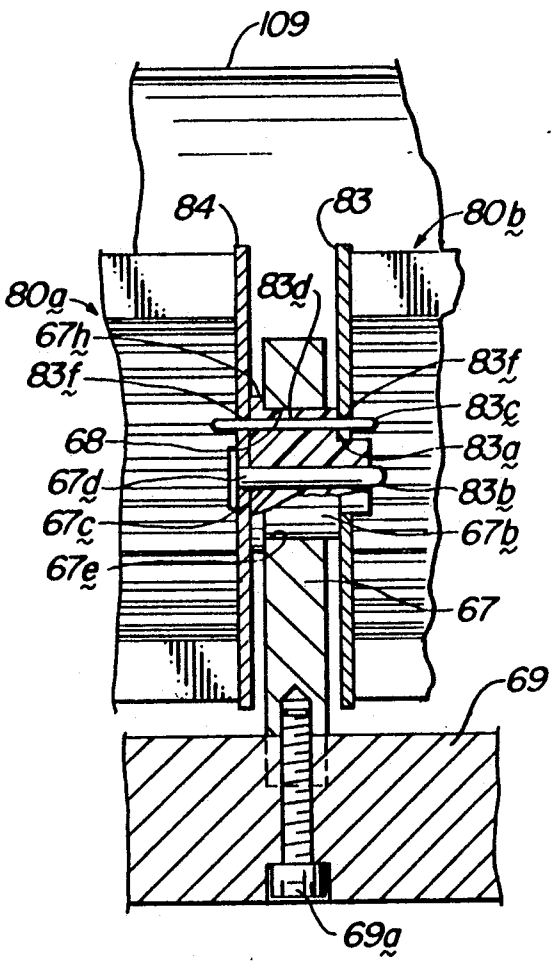
FIG. 5 is a cross-sectional view taken along line 5—5 of FIG. 4.
Figure 4:
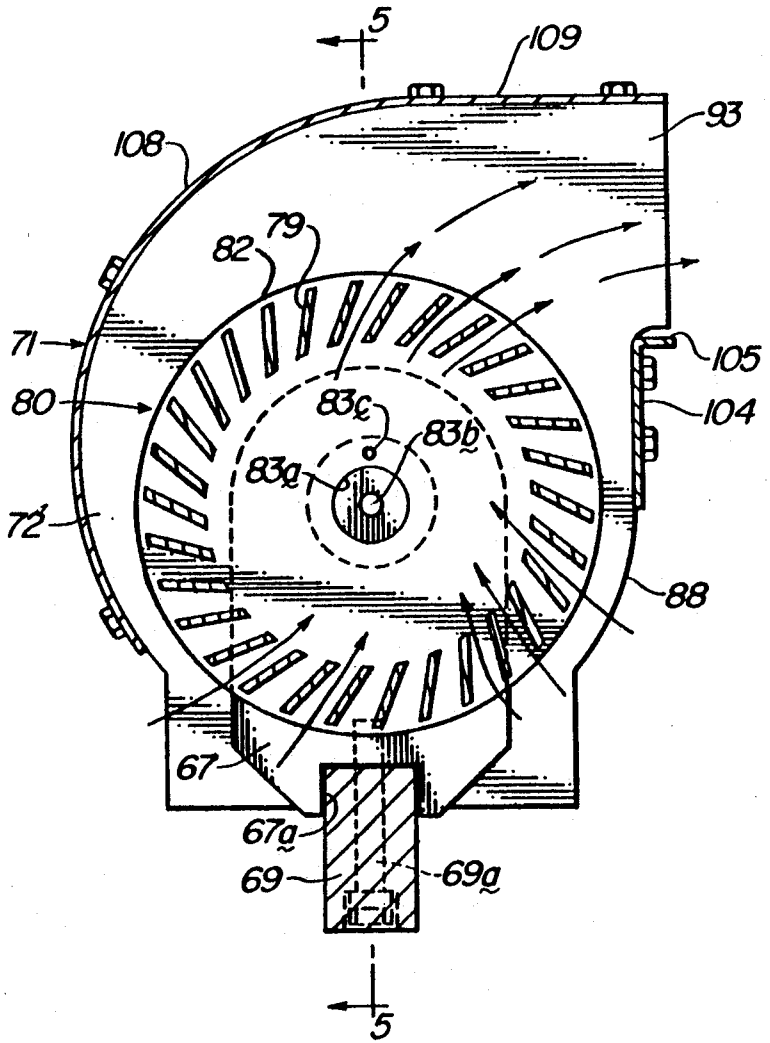
FIG. 4 is a cross-sectional end view taken along line 4—4 of FIG. 3.
Figure 6:
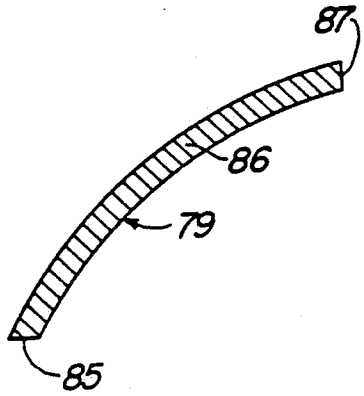
FIG. 6 is an enlarged cross-sectional view through a blade.

As illustrated in FIGS. 4 and 5 of the drawing, each impeller end plate 83 has an enlarged central opening 83*a* while a stub shaft 83*b* extends outwardly from the central portion of each end plate 84.

An upright support member 67 having a groove 67*a* formed in the lower end thereof straddles and is supported by a rigid support bar 69 extending transversely between the side frames of the press. Spaced cap screws 69*a* extend through openings in the support bar 69 and have an upper end extending into an internally threaded opening formed centrally of the groove 67*a* in the support member 67, said threaded opening being spaced substantially equal distance between the legs which engage opposite sides of the support bar 69.

The support bar 69 is bolted or otherwise detachably secured to the side frames 15 and 16.

The support member 67 has a central opening 68 through which a stepped bushing 67*b* extends. The stepped bushing 67*b* has a central opening 67*c* to receive a stub shaft 67*d* secured to the end plate 84 on one of the impeller segments. The bushing 67*b* has a reduced diameter outer end 67*e* which extends into the opening 83*b* formed in end plate 83 on the other impeller segment. An enlarged head 67*h* is formed on the opposite end of the bushing 67*b* and engages the surface of the support member 67 and extends around the periphery of the opening 68 formed therein.

A drive pin 83*c* extends through an opening 83*d* in the stepped bushing 67*b* and through apertures 83*f* formed in the end plates 83 and 84.

Referring to FIG. 5 of the drawing, it should be readily apparent that rotation of one of the impeller segments 80*a* imparts rotation to the other impeller segment 80*b* through the drive pin 83*c*.

Figure 2:
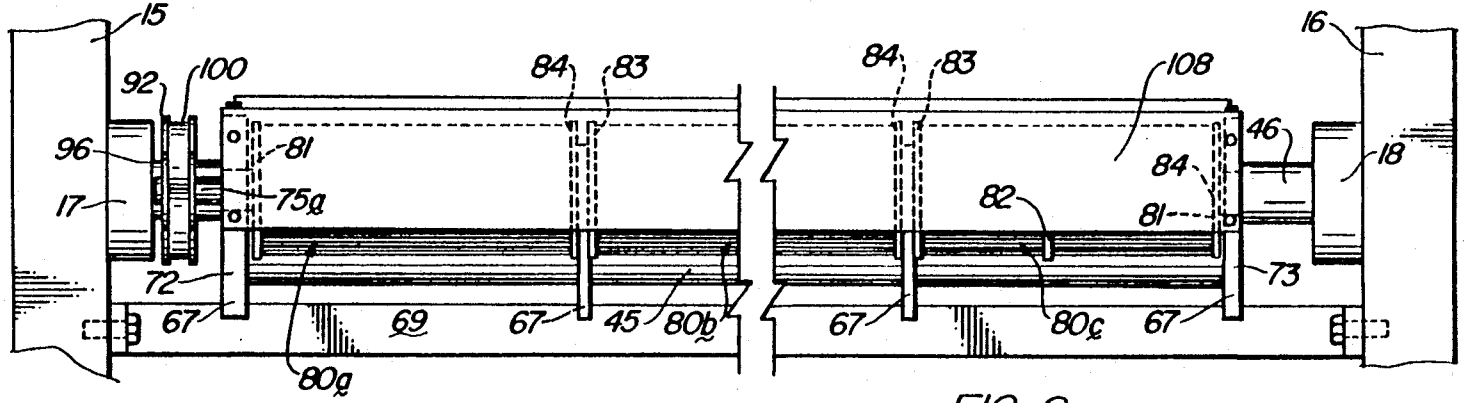
FIG. 2 is a side view of the blower assembly.

As best illustrated in FIGS. 2 and 3 of the drawing, it will be noted that one of the support members 67 is positioned intermediate adjacent ends of each impeller segment 80*a* and 80*b*, and 80*b* and 80*c*.

Referring now to FIGS. 2, 3 and 4 of the drawing, dampening fluid evaporator 70 comprises an elongated fan assembly in a housing 71 having end shrouds 72 and 73, tail shafts 75*a* and 75*b*, end bearings 76 and 77, and an impeller generally designated by the numeral 80.

The fan impeller segments 80*a*, 80*b* and 80*c* hereinbefore described are commercially available from Dayton Electric Manufacturing Co. of Chicago, Ill. and a similar fan is generally referred to as a "Dayton" transflow blower Model 4C874. The blower is a single speed unit designed for heating, cooling, exhausting, ventilating and drying applications. The blowers are conventionally driven by a shaded-pole motor with automatic-reset thermal protection. Dayton form 5S2814, which is incorporated herein by reference in its entirety, contains a description and specifications of the blower.

The transverse-flow fan illustrated in FIGS. 2-4 advantageously causes the air to pass through the blades 79 twice, entering substantially tangentially through the tip, passing across the impeller 80 and out the other side. The fan housing 71 is designed to provide the transverse flow of air. The end shrouds 72 and 73 have no inlet holes. It should be appreciated that since the fan impeller 80 does not depend upon flow of air in an axial direction, the blade length and tip diameter ratios are limited only by structural considerations. Thus, the impeller 80 having an outside diameter of approximately 2.5 inches and a length for example, 38 inches provides a substantially uniform flow of air along the length of the impeller 80.

Impeller 80 comprises spaced circular retaining end plates 81 and 84, stabilizing plates 82 and 83, and a plurality of fan blades 79, each fan blade 79 having a heel 85, a curved central body portion 86, and a tip 87.

As best shown in FIGS. 3 and 4 of the drawing, fan blades 79 are perpendicularly disposed relative to press side frames 15 and 16 and are secured between retaining plates 81 and 84 in circular fashion relative to retaining plates 81 and 84 such that fan blades 79 are symmetrically disposed at equidistant intervals along the periphery of retaining plates 81 and 84 forming a cylindrical impeller 80. Fan blades 79 are angularly disposed between retaining plates 81 and 84 such that as impeller 80 is rotated, the tip 87 of each fan blade 79 serves as a leading edge of the fan blades 79 and the heel 85 serves as a trailing edge of fan blade 79 relative to the direction of rotation. Fan blades 79 are provided with a shallow forward curved central body portion 86 which points both tip 87 and heel 85 in the direction of rotation of the impeller 80. Stabilizing plates 82 and 83 are positioned between and at equidistant intervals from retaining plates 81 and 84. Fan blades 79 extend longitudinally through corresponding slots not shown in stabilizing plates 82 and 83. Stabilizer plates 82 and 83 are essentially "washer shaped," having a circular configuration of equal diameter as retaining plates 81 and 84, substantially flat surfaces disposed perpendicularly to fan blades 79, and a central bore therethrough.

Retaining plates 81 and 84 are secured to shafts 75*a* and 75*b* which extend through bearings 76 and 77, respectively along a central axis 74 for permitting rotation of impeller 80 around central axis 74. End bearing 77 is secured to the end shroud 73 of housing 71. End bearing 76 is secured to the end shroud 72 of housing 71. End shroud 72 has an aperture 78 aligned with central axis 74 for permitting the tail shaft 75*a* extending through end bearing 76 to extent longitudinally through aperture 78 to the outside of housing 71. Pulley 96 is secured to tail shaft 75*a* by key 98.

As best shown in FIGS. 1, 3 and 4, housing 71 comprises a cover shield 101, and a directional member 104 positioned in spaced apart relation around impeller 80 and secured between end shrouds 72 and 73. Cover shield 101, directional member 104, and end shields 72 and 73 substantially enclose impeller 80 and cause air to be channeled through the openings therebetween, said openings serving as air intake vent 88 and blower port 93.

Cover shield 101 having a curved rear portion 108 and a substantially straight front portion 109 is axially positioned above and adjacent to impeller 80 such that the curved real portion 108 is positioned in eccentric alignment around impeller 80 and the front portion 109 extends away from impeller 80 toward ink distribution roller 45 for channelling air from impeller 80 and directing air to impinge on ink distribution roller 45. The eccentric alignment of the curved real portion 108 of cover shield 101 and impeller 80 forms a progressively expanding air acceleration chamber 59 between cover shield 101 and impeller 80 extending from the rear of impeller 80 and tapering outwardly to blower port 93.

Directional member 104 comprises an angular channel having an upper fin 105 and is positioned between impeller 80 and ink distribution roller 45. Directional member 104 is perpendicularly aligned relative to side frames 15 and 16 and secured at its ends to end shrouds 72 and 73. Upper fin 105 of directional member 104 is aligned in parallel spaced apart relation to front portion 109 of cover shield 101, the space therebetween forming blower port 93 for directing air from impeller 80 to impinge against ink distribution roller 45.

End shrouds 72 and 73 in the illustrated embodiment are substantially identical to support members 67 and enclose the ends of evaporator 70. Similarly, the curved portion 108 of cover shield 101 and lower fin 106 of directional member 104 are positioned on opposite sides of impeller 80, the space therebetween and beneath impeller 80 forming air intake vent 88.

As will be readily apparent from the description of the preferred embodiment heretofore discussed, rotation of impeller 80 draws air through air intake vent 88, passes air through an air acceleration chamber 59, and exhausts air through blower port 93 to impinge against ink distribution roller 45 for evaporating excess dampening fluid from the inking system 20 of printing press 10. The method and operation of the dampening fluid evaporator described and illustrated in conjunction with the drawing is believed to be readily understandable by those skilled in the art.

Dampening fluid is evaporated from the surface of a roller 45 in inking system 20 by positioning a fan 80 adjacent roller 45 and providing appropriate drive means 90 coupling roller 45 and fan 80 such that the rotation of roller 45 imparts force to drive fan 80 causing air to impinge against roller 45 for evaporating dampening fluid on the surface of roller 45. According to a preferred embodiment of the present invention, a transflow blower 80 is mounted in a printing press 10, parallel and adjacent to ink distribution roller 45 and driven by a flexible belt mounted around a drive pulley secured to roller 45, and a driven pulley secured to transflow blower 80.

Opposite ends 81 of the impeller 80 are supported in end plates 72 to which the blower housing is attached by screws or other suitable fastener means.

The blower housing consists a cover shield 101 and a directional member 104. The curved portion 108 of the cover shield 101 and the directional member 104 are positioned on opposite sides of impeller 80, the space there between and beneath the impeller 80 forming air intake vent 88. The upper portion 109 of the cover shield and the upper fin 105 of directional member 104 are aligned in parallel spaced apart, the space therebetween forming blower port 93 for directing air from impeller.

Figure 7:
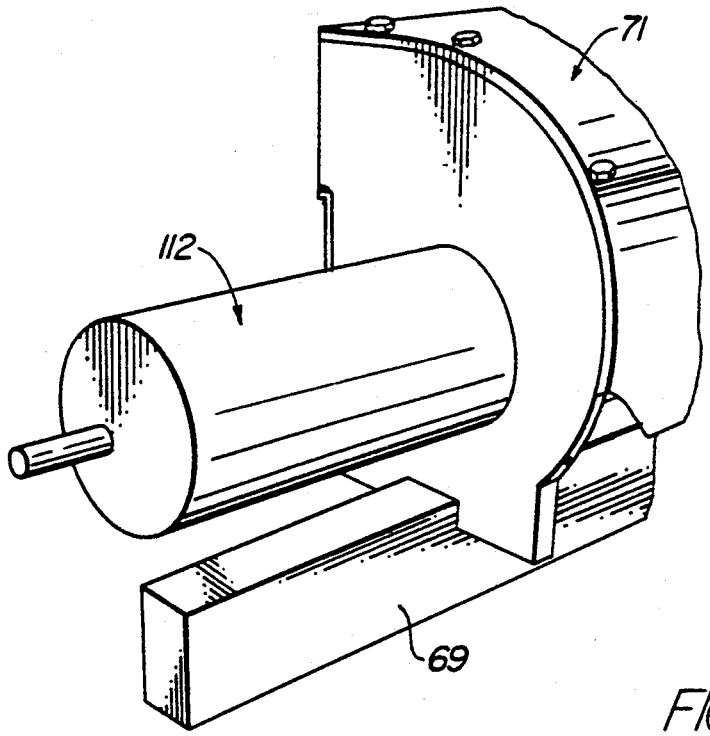
FIG. 7 is a fragmentary perspective view of the blower assembly of the first embodiment.
Figure 9:
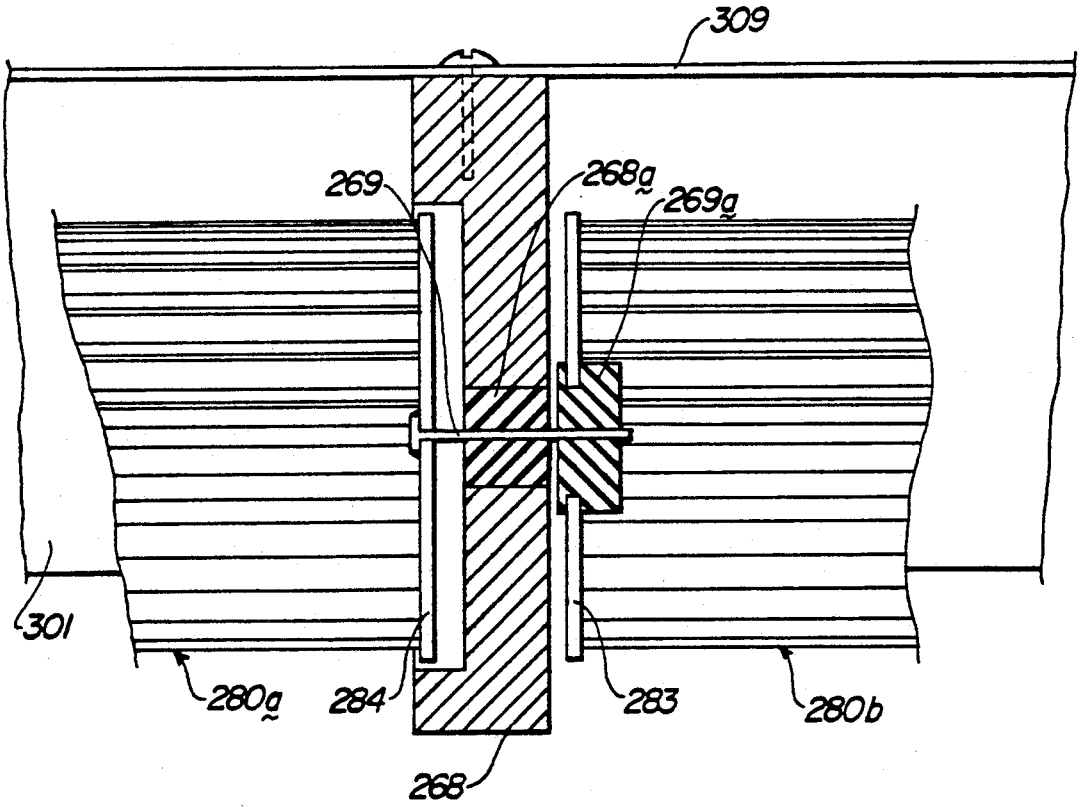
FIG. 9 is a cross-sectional view taken along line 9—9 of FIG. 8.

As an alternative means of rotation, a variable speed electric motor 112 may be bolted or otherwise secured to one of the end plates with a shaft which is drivingly connected to the impeller segment 80*a*, as illustrated in the embodiments in FIGS. 7 and 9 of the drawing.

DESCRIPTION OF SECOND PREFERRED EMBODIMENT

Figure 8:
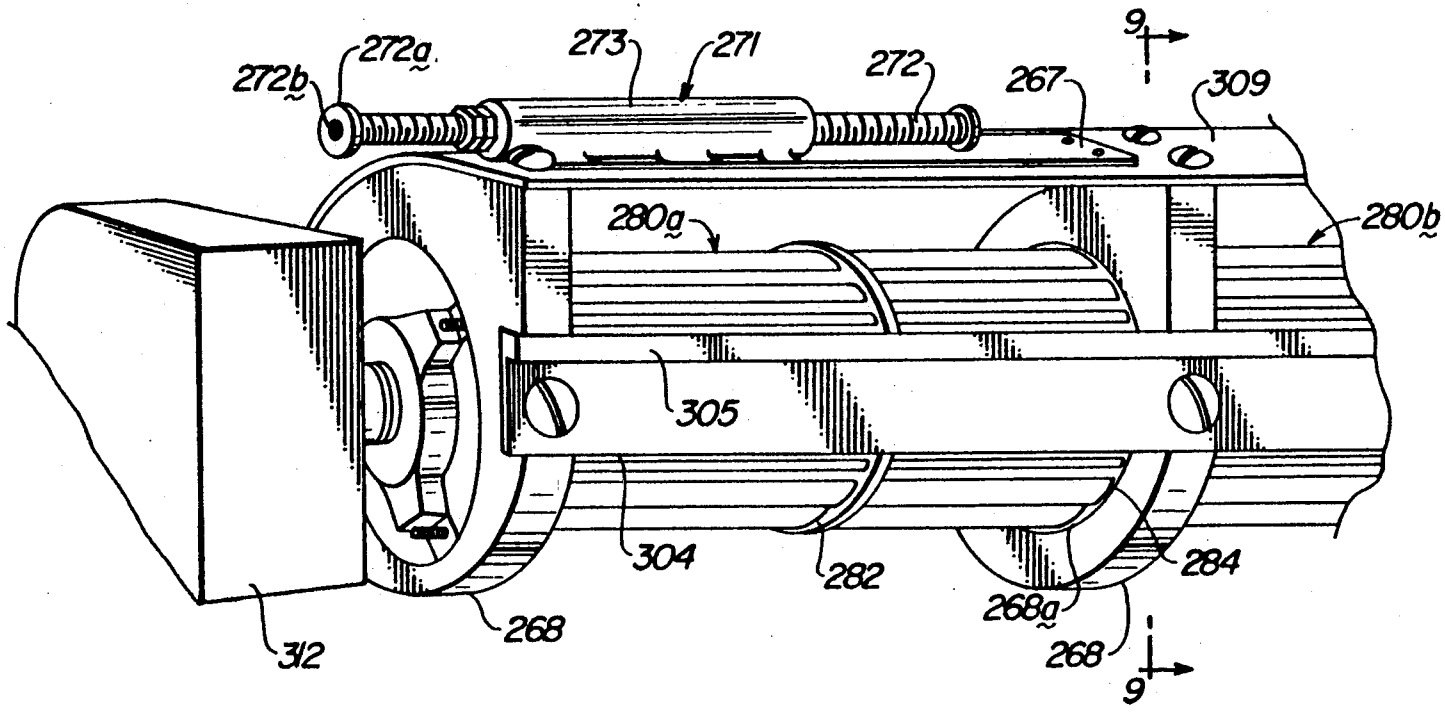
FIG. 8 is a fragmentary perspective view of the second embodiment.

In the second embodiment of the invention illustrated in FIGS. 8 and 9, as in the first embodiment, the impeller 280 comprises a plurality of impeller segments 280*a*, 280*b*, and 280*c* connected end to end and adapted to rotate together as a unit. The impeller segments vary in length to accommodate various printing presses. To stiffen the longer impeller segments, a segment may have one or more stabilizer plates 282 positioned at intermediate points along the segment through which the impeller blades pass.

As illustrated in FIG. 8 of the drawing, each impeller segment is provided with an end plate 283 at one end thereof and an end plate 284 adjacent the opposite end thereof, impeller blades 279 extending therebetween. Impeller end plates 283 have an enlarged central opening with a plastic grommet 269*a* in the opening which receives a stub shaft 269 extending outwardly from the central portion of adjacent stabilizing plate 284 or receives the shaft of a rotation means.

An upright support member 268, providing a framework for the housing of the blower, has a circular inset 268*a* formed on one side with an enlarged circular opening located centrally in the inset. A bushing 268*b* is located in said opening through which the stub shaft of an impeller segment 280*a* passes to insert into the grommet of an adjacent impeller segment 280*b*, or through which the shaft of a rotation means passes through to insert into the grommet of the first impeller segment 280*a*. The insert faces the direction of the incoming shaft, whether the shaft is connector means on an end plate 284 of an adjacent impeller segment or a rotation means.

The blower housing comprises a cover shield 301 and a directional member 304. The curved portion 308 of the cover shield 301 and the directional member 304 are positioned on opposite sides of impeller 280, the space there between and beneath the impeller 280 forming air intake vent 288. The upper portion 309 of the cover shield and the upper fin 305 of directional member 304 are aligned in parallel spaced apart, the space therebetween forming blower port 293 for directing air from impeller.

The evaporator is preferably mounted to evaporate excess dampening fluid from the surface of ink distribution roller 45 to prevent accumulation of excessive quantities of dampening fluid on the surface of train rollers in inker 20.

As best illustrated in FIGS. 8 and 9, the evaporator is supported by a mounting means attached to the upper portion of the cover shield 309. The mounting means includes a racheting means 271 supporting the evaporator from the side frames 15 and 16 of the press and includes a pair of internally threaded tubular members 273, a pair of threaded shafts 272 with threaded nuts and locknuts, two circular bearing plates 272*a* on the end of the shafts with one or two pointed tips of hardened steel 272*b*, and two rectangular bearing plates 267 to which the threaded tubular members 273 are welded. The rectangular bearing plate 267 is mounted to the upper portion of the cover shield 309 by fastener means. Each shaft 272 threads into and through the tubular member 273 and to prevent the threaded shafts from disengaging from the tubular member, the far end of the shaft shall have a means to prevent further revolutions of the shaft once the end of the shaft is near flush with the tubular member. This means includes a plate attached to the end of the shaft. The threaded nut and locknut on each shaft shall be located between the tubular member and the circular bearing plate which bears against the side frame of the press such that when the nut is tightened against the tubular member, the shaft is fixed in position.

The blower is operated by a suitable rotation means comprising a variable speed motor with a shaft extending through the plastic bearing of the end support member 268 and into the grommet of the impeller segment 280*a* end plate 283.

Although a preferred embodiment of the invention has been described herein, those skilled in the art will also appreciate that various substitutions and modifications may be made to the specific arrangement described without departing from the scope and spirit of the invention as recited in the appended claims.

What is claimed is:

1. A method of evaporating liquid from the surface of a roller which rotates about an axis in a printing press comprising the steps of: mounting an elongated transflow blower housing spaced from and parallel to the axis about which the roller in the printing press rotates such that opposite ends of the elongated transflow blower housing are positioned adjacent opposite ends of the roller; supporting a plurality of fan means end to end in the blower housing such that fan blade means extend longitudinally of substantially the entire length of the roller such that ends of the blade means are positioned adjacent opposite ends of the roller in the printing press; and driving the fan blade means to draw and deliver air transversely of the roller while minimizing air flow in a direction parallel to the axis of the transflow blower housing.

2. A method according to claim 1, the step of driving the fan blade means comprising: providing a drive pulley to rotate with the roller; providing a driven pulley to rotate with the fan blade means; and mounting a drive member on the drive pulley and the driven pulley such that the drive member imparts force to the driven pulley for rotating the elongated blade means.

3. A method according to claim 1, the step of driving the fan blade means comprising: driving the fan blade means with a variable speed electric motor.

4. A dampening fluid evaporator adapted to be mounted to evaporate dampening fluid from a roller rotatable about a roller axis in a lithographic printing press comprising: an elongated transflow blower having elongated impeller segments, a longitudinal axis and spaced ends; mounting means to mount said transflow blower adjacent the roller in a lithographic printing press, said mounting means being adapted to position opposite ends of said blower adjacent opposite ends of the roller; means mounting said impeller segments end to end such that said elongated impeller segments extend generally parallel to the roller axis; and drive means to rotate said impeller segments to draw air transversely of said blower, along substantially the entire length of the roller, and to deliver air toward the roller to evaporate dampening fluid from the roller.

5. A dampening fluid evaporator for a lithographic printing press according to claim 4, said drive means to rotate said transflow blower impeller segments comprising: a motor connected to said transflow blower impeller segments.

6. A dampening fluid evaporator for a lithographic printing press according to claim 4, said mounting means to mount said blower housing comprising: a rigid support bar; and means to secure said support bar to said blower and relative to an inker side frame.

7. A dampening fluid evaporator for a lithographic printing press according to claim 4, said mounting means comprising: a rigid blower housing having an elongated intake opening and an elongated discharge opening; means to mount said impeller segments in said rigid housing adjacent the roller in a lithographic printing press such that said blower axis and the roller axis are substantially parallel; and an electric motor to rotate said impeller segments to draw air through said elongated intake opening along substantially the entire length of the roller and to deliver air through said elongated discharge opening toward the surface of the roller along substantially the entire length of the roller to evaporate dampening fluid from the surface of the roller.

8. A lithographic printing press comprising: a pair of press side frames; a plate cylinder rotatably secured between said press side frames; a printing plate secured to said plate cylinder; a plurality of form rollers rotatably secured between said side frames and positioned to apply ink to said printing plate; a plurality of vibrator rollers rotatably secured between said press side frames and mounted in rolling engagement with said form rollers; at least one ink distributor roller rotatably mounted between said press side frames and in rolling relation with at least one of said vibrator rollers; transflow blower housing having an elongated intake passage extending longitudinally of said distributor roller; means mounting said transflow blower housing such that opposite ends of said intake passage are positioned adjacent opposite ends of said distributor roller; a plurality of impeller segments; means mounting said impeller segments end to end to form an elongated impeller; and drive means rotating said impeller segments for delivering air to evaporate liquid carried on said distributor roller.

9. A lithographic printing press according to claim 8, said drive means comprising: an electric motor.

10. A lithographic printing press according to claim 8, each of said impeller segments comprising: a plurality of blades, each of said blades having a tip and a heel; a pair of end shrouds; means mounting said blades between said end shrouds such that the tip of each blade points in the direction of rotation and such that the heel of each blade is positioned circumferentially rearwardly of said blade tip to form forwardly curved blades.

11. A lithographic printing press according to claim 8, said impeller segments being of different lengths to permit fabrication of an impeller of a predetermined length.

12. A lithographic printing press comprising: a pair of press side frames; inker means supported by said press side frames; printing means adjacent said inker means; dampener means associated with said inker means for delivering ink and dampening fluid to said printing means, said inker means including distributor roller means; a plurality of elongated transflow blower elements having a longitudinal axis; a blower housing having elongated inlet and outlet passages; means rotatably securing each of said transflow blower elements end to end in said blower housing; means securing said blower housing relative to press side frames such that said elongated inlet and outlet passages into said transflow blower housing are positioned adjacent distributor roller; and drive means to rotate said transflow blower elements to deliver air directly from said elongated outlet passage onto said distributor roller along the length of said distributor roller to evaporate dampening fluid.

* * * * *